US009222151B2

(12) United States Patent
Xing et al.

(10) Patent No.: US 9,222,151 B2
(45) Date of Patent: Dec. 29, 2015

(54) ALUMINUM ALLOY EXCELLENT IN HIGH TEMPERATURE STRENGTH AND HEAT CONDUCTIVITY AND METHOD OF PRODUCTION OF SAME

(75) Inventors: Jie Xing, Shizuoka (JP); Izumi Yamamoto, Shizuoka (JP); Kazuhiro Oda, Shizuoka (JP); Yutaka Ishida, Shizuoka (JP); Hiroshi Horikawa, Tokyo (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 117 days.

(21) Appl. No.: 13/810,508

(22) PCT Filed: Jul. 6, 2011

(86) PCT No.: PCT/JP2011/065917

§ 371 (c)(1),
(2), (4) Date: Jan. 16, 2013

(87) PCT Pub. No.: WO2012/008470

PCT Pub. Date: Jan. 19, 2012

(65) Prior Publication Data

US 2013/0115129 A1 May 9, 2013

(30) Foreign Application Priority Data

Jul. 16, 2010 (JP) ..... 2010-161167

(51) Int. Cl.
*B22D 27/02* (2006.01)
*C22C 21/08* (2006.01)
(Continued)

(52) U.S. Cl.
CPC ..... *C22C 21/02* (2013.01); *B22D 21/007* (2013.01); *B22D 23/00* (2013.01); *C22C 1/026* (2013.01); *C22F 1/043* (2013.01); *C22F 3/02* (2013.01)

(58) Field of Classification Search
CPC ..... C22C 21/02; C22C 1/026; B22D 21/007; B22D 23/00; C22F 1/043; C22F 3/02
USPC ..... 420/434, 435
See application file for complete search history.

(56) References Cited

U.S. PATENT DOCUMENTS

| | | | | |
|---|---|---|---|---|
| 4,434,014 | A | 2/1984 | Smith | |
| 5,484,492 | A * | 1/1996 | Rogers et al. | 148/437 |
| 2007/0068604 | A1 * | 3/2007 | Shioda et al. | 148/439 |

FOREIGN PATENT DOCUMENTS

| | | | | |
|---|---|---|---|---|
| CN | 101709414 | A | 5/2010 | |
| EP | 2 048 259 | * | 4/2009 | C22F 1/043 |

(Continued)

OTHER PUBLICATIONS

English Abstract and English Machine Translation of Sasaki (JP 10-226840) (Aug. 25, 1998).*

(Continued)

*Primary Examiner* — Jessee Roe
(74) *Attorney, Agent, or Firm* — Miller, White, Zelano, Branigan, P.C.

(57) ABSTRACT

An aluminum alloy which is excellent in high temperature strength and heat conductivity by adjusting the composition to one keeping down the drop in high temperature strength and making the Mn content as small as possible to reduce the formation of a solid solution in the aluminum, which aluminum alloy having a composition of ingredients which contains Si: 12 to 16 mass %, N: 0.1 to 2.5 mass %, Cu: 3 to 5 mass %, Mg: 0.3 to 1.2 mass %, Fe: 0.3 to 1.5 mass %, and P: 0.004 to 0.02 mass % and furthermore 0 to 0.1 mass % of Mn and further contains, as necessary, at least one of V: 0.01 to 0.1 mass %, Zr: 0.01 to 0.6 mass %, Cr: 0.01 to 0.2 mass %, and Ti: 0.01 to 0.2 mass %. Also described is a method for producing the aluminum alloy melt.

5 Claims, 2 Drawing Sheets

(51) Int. Cl.

| | |
|---|---|
| ***C22C 21/02*** | (2006.01) |
| ***B22D 21/00*** | (2006.01) |
| ***C22C 1/02*** | (2006.01) |
| ***C22F 1/043*** | (2006.01) |
| ***C22F 3/02*** | (2006.01) |
| ***B22D 23/00*** | (2006.01) |

(56) References Cited

FOREIGN PATENT DOCUMENTS

| | | | |
|---|---|---|---|
| JP | 04-72033 | A | 3/1992 |
| JP | 10-226840 | A | 8/1998 |
| JP | 2002-249840 | A | 9/2002 |
| JP | 2004-209487 | A | 7/2004 |
| JP | 2007-216239 | A | 8/2007 |
| JP | 2008-127665 | A | 6/2008 |
| WO | 00/71767 | A1 | 11/2000 |

OTHER PUBLICATIONS

English Translation ABSTRACT of CN 101709414 published May 19, 2010.

International Search Report of PCT/JP2011/065917 (Sep. 6, 2011).

Chinese Office Action dated Dec. 11, 2014 issued in corresponding CN 201180034918.2 application (pp. 1-7).

* cited by examiner (a)

(b)

ALUMINUM ALLOY EXCELLENT IN HIGH TEMPERATURE STRENGTH AND HEAT CONDUCTIVITY AND METHOD OF PRODUCTION OF SAME

TECHNICAL FIELD

The present invention relates to an aluminum alloy which is used for automobile pistons etc. and is excellent in high temperature strength and heat conductivity and to a method of production of the same.

BACKGROUND ART

Aluminum alloy generally falls in strength the higher the temperature. Therefore, to maintain the high temperature strength in an aluminum alloy which is used for an automobile piston or under other high temperature conditions, in the past the practice has been to increase the amounts of addition of Si, Cu, Ni, Mg, Fe, Mn, etc. and increase the precipitates of second phase particles etc.

Among these elements which are added for improving the high temperature strength, Mn is added for improving the properties of the Fe-based compound. An Fe-based compound is effective for improvement of the high temperature strength, but tends to coarsen in a needle shape. If coarsening, the mechanical properties fall. For this reason, the practice has been to add Mn to convert the Fe-based compound to an α-form (for example, see Japanese Patent No. 4075523 and Japanese Patent No. 4026563).

Further, on the other hand, when increasing the amount of addition, the precipitates coarsen and become starting points of easy breakage, so the room temperature strength falls. Therefore, for example, as seen in Japanese Patent Publication No. 2007-216239 A1, to reduce the drop in the room temperature strength, when casting the aluminum alloy, the practice has been to treat the aluminum alloy melt ultrasonically at a temperature of the liquidus line or more so as to suppress the formation of coarse intermetallic compounds, that is, to make the structure finer.

SUMMARY OF INVENTION

However, if, as proposed in Japanese Patent No. 4075523 or Japanese Patent No. 4026563, adding Mn for the purpose of improving the high temperature strength of the aluminum, part will end up forming a solid solution in the aluminum and causing a drop in the heat conductivity of the aluminum alloy. If using such an alloy for a piston or other part which is used at a high temperature, there is the problem that the aluminum alloy member will end up becoming high in temperature and end up being used in a state with a fallen strength.

Further, Japanese Patent Publication No. 2007-216239 A1 improves the strength by ultrasonic treatment at the liquidus line or more so as to make the structure finer but does not make any specific proposal of an aluminum alloy which is adjusted to a composition which is excellent in high temperature strength and heat conductivity.

The present invention was created to solve such a problem and has as its object to adjust the composition to one which suppresses the drop in high temperature strength and to reduce the content of Mn as much as possible to reduce the solid solution formed inside the aluminum and thereby provide an aluminum alloy which is excellent in high temperature strength and heat conductivity.

The aluminum alloy which is excellent in high temperature strength and heat conductivity of the present invention, to realize this objective, is characterized by having a composition of ingredients which contains Si: 12 to 16 mass %, N: 0.1 to 2.5 mass %, Cu: 3 to 5 mass %, Mg: 0.3 to 1.2 mass %, Fe: 0.3 to 1.5 mass %, and P: 0.004 to 0.02 mass % and comprises a balance of Al and unavoidable impurities.

Further, it may be one having a composition of ingredients which contains Si: 12 to 16 mass %, Ni: 0.1 to 2.5 mass %, Cu: 3 to 5 mass %, Mg: 0.3 to 1.2 mass %, Fe: 0.3 to 1.5 mass %, P: 0.004 to 0.02 mass %, and, furthermore, 0.1 mass % or less of Mn and comprises a balance of Al and unavoidable impurities.

Furthermore, the composition of ingredients may contain at least one of 0.01 to 0.1 mass % of V and 0.01 to 0.6 mass % of Zr.

Still further, the composition of ingredients may contain at least one of 0.01 to 0.2 mass % of Cr and 0.01 to 0.2 mass % of Ti.

Further, when adopting a 0.2 $mm^2$ field of view, the alloy preferably has a metal structure where an average of 10 precipitates which are the largest in size in the longitudinal direction of the precipitates is 230 μm or less.

By treating an aluminum alloy melt which has such a composition of ingredients ultrasonically at a temperature of the liquidus line or more and casting it within 100 seconds after the end of the ultrasonic treatment, it is possible to improve the room temperature characteristics and obtain an aluminum alloy which is excellent in workability.

The aluminum alloy of the present invention is improved in the high temperature strength by the combination of the small specific gravity Si and strengthening elements, is light in weight, and is excellent in specific strength. On the other hand, by eliminating the addition of Mn, which forms a solid solution in aluminum and lowers the heat conductivity, or keeping the amount of addition down to 0.1 mass % or less, it is possible to introduce the added Mn to the Fe-based intermetallic compounds and thereby change the Fe-based intermetallic compounds to masses and obtain an aluminum alloy which is excellent in high temperature strength and is excellent in heat conductivity.

Furthermore, in the aluminum alloy of the present invention, by treating the aluminum melt at the time of casting ultrasonically at the liquidus line or more, the precipitates can be made refined and dispersed, so it is possible to obtain aluminum alloy which is improved in room temperature strength and is excellent in workability.

DESCRIPTION OF EMBODIMENTS

Figure 1:
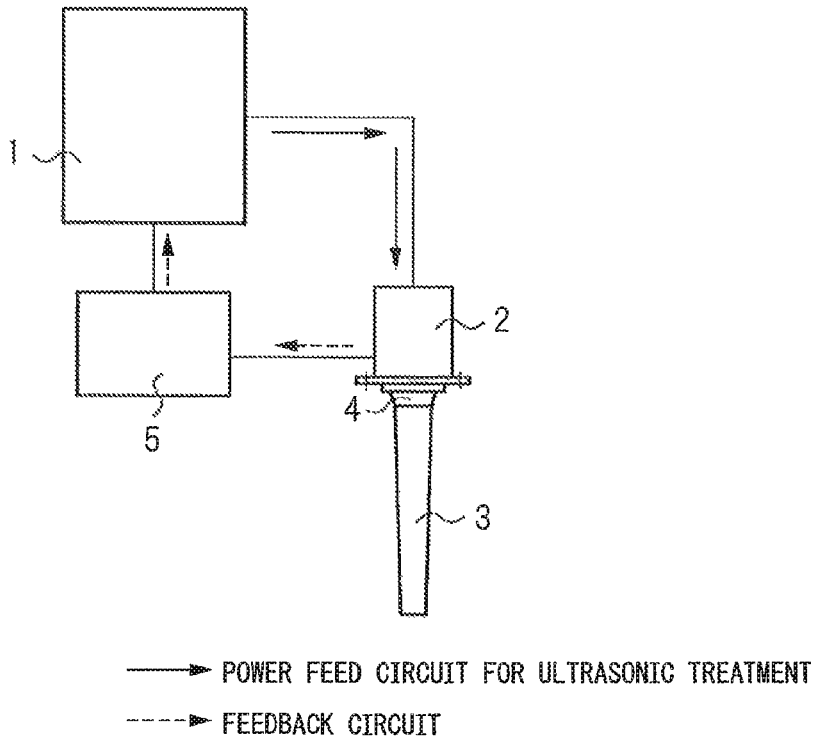
FIG. 1 explains an ultrasonic treatment device using an ultrasonic horn.

The inventors engaged in intensive studies to obtain an aluminum alloy material, which can be used for automobile pistons etc. and are excellent in high temperature strength and heat conductivity, at low cost. In the process, they found that by finely adjusting and combining the amounts of addition of Si and strengthening elements, it is possible to improve the high temperature strength and, further, by stopping the addition of Mn, which forms a solid solution in aluminum and lowers the heat conductivity, or by reducing the amount of addition as much as possible, it is possible to obtain an aluminum alloy which is excellent in heat conductivity.

This will be explained more specifically. In an Al—Si-based alloy to which a large amount of Fe is added, needle-shaped Al—Fe—Si-based precipitates coarsen and the strength easily drops. For this reason, usually, Mn is added to form the precipitate into masses. By forming the precipitate into masses, the drop in strength is attempted to be suppressed. However, not all of the added Mn precipitates as Al—Fe—Mn—Si-based precipitate. Part forms a solid solution in the aluminum, so ends up causing the heat conductivity to drop.

On the other hand, if making the needle-shaped Al—Fe—Si-based precipitate finely disperse, the mass shaped Al—Fe—Mn—Si-based precipitate becomes higher in high temperature strength compared with the dispersed one. Further, if eliminating the addition of Mn, Mn will not form a solid solution in the aluminum either, so the drop in heat conductivity can also be suppressed. Therefore, in the present invention, the coarsening of the Al—Fe—Si-based precipitate is suppressed by keeping down the amount of addition of Fe or otherwise adjusting the composition of ingredients and, also, by stopping the addition of Mn, or keeping the amount of addition to a minimum, so as to eliminate the formation of a solid solution of Mn in the aluminum and prevent the drop in heat conductivity.

Further, by treatment the melt ultrasonically at the time of casting, the refinement of the precipitate is promoted.

Details will be explained below.

First, the composition of ingredients of the aluminum alloys which are used will be explained.

Si: 10 to 16 Mass %

Si has the action of improving the high temperature strength. This effect particularly is realized with Si: 10 mass % or more. If over 16 mass %, the heat conductivity falls. Further, if the amount of precipitation becomes greater, the elongation at room temperature falls and the workability deteriorates. Therefore, this is added in a range not exceeding 16 mass %.

Ni: 0.1 to 2.5 Mass %

Ni has the action of improving the high temperature strength without detrimentally affecting the heat conductivity. If adding this simultaneously with Cu, this precipitates as an Al—Ni—Cu-based compound and improves the high temperature strength by dispersion strengthening. If less than 0.1 mass %, such an effect cannot be expected, while if over 2.5 mass %, the alloy density becomes higher and no further improvement in the specific strength can be obtained any longer.

Cu: 3 to 5 Mass %

Cu has the action of improving the high temperature strength. If adding this simultaneously with Ni, this forms an Al—Ni—Cu-based compound which improves the high temperature strength by dispersion strengthening. This action becomes remarkable with addition of 3 mass % or more, but if over 5 mass %, the heat conductivity ends up being made lower. Further, the alloy density becomes higher and the specific strength can no longer be improved. Therefore, the amount of addition of Cu is made 3 to 5 mass %.

Mg: 0.3 to 1.2 Mass %

Mg is effective for improving the high temperature strength. In particular, when treating the melt ultrasonically, the addition of Mg results in cavitation occurring more easily, so a refining effect is exhibited. This action becomes remarkable with addition of 0.3 mass % or more, but if over 1.2 mass %, the heat conductivity is made to fall. Further, the elongation falls and casting cracks more easily occur. Therefore, the amount of addition of Mg is made 0.3% to 1.2 mass % in range.

Fe: 0.3 to 1.5 Mass %

Fe, if made to be added simultaneously with Si, forms an Al—Fe—Si-based precipitate to thereby contribute to dispersion strengthening and improve the high temperature strength. This effect is exhibited with an amount of addition of Fe of 0.3 mass % or more, but if adding a larger amount exceeding 1.5 mass %, coarsening occurs, so the mechanical properties conversely fall. Furthermore, if the amount of addition of Fe is large, the heat conductivity rapidly falls. To suppress coarsening of the precipitates while realizing the advantageous effect, the content of Fe has to be adjusted to 0.3 to 1.5 mass %.

P: 0.004 to 0.02 Mass %

P forms an AlP compound and acts as a heterogeneous nucleus of Si. Due to this, it has the action of refining Si and causing uniform dispersion. This action is particularly effective at 0.004 mass % or more. If over 0.02 mass %, the melt flowability becomes poor and the castability ends up falling. Therefore, the amount of addition of P is made 0.004 to 0.02 mass % in range.

Mn: 0 to 0.1 Mass %

Mn is taken into the precipitates comprised of Al—Fe—Si-based intermetallic compounds and has the action of forming the precipitates into masses. However, if added in large amounts, the entire amounts are not taken into the precipitate: the excess parts form solid solutions in the aluminum and cause the heat conductivity of the alloy as a whole to fall. Therefore, the amount of addition of Mn has to be made 0 mass % or 0.1 mass % or less.

V: 0.01 to 0.1 Mass %, Zr: 0.01 to 0.6 Mass %

V and Zr contribute to refining the macrostructure and causing uniform dispersion, but lower the heat conductivity, so are added as needed. Note that, V and Zr exhibit their effects with addition of at least one type, but when adding V, the amount of lattice strain is large and the heat conductivity easily falls, so the amount of addition of V is made 0.1 mass % or less. On the other hand, if adding Zr, the amount of lattice strain is smaller than V and Zr-based precipitates form, so the amount of solid solution is reduced and the heat conductivity drops. Therefore, Zr can be added up to 0.6 mass %.

Cr: 0.01 to 0.2 Mass %, Ti: 0.01 to 0.2 Mass %

Cr and Ti improve the Al—Fe—Si-based compound and simultaneously form heterogeneous nuclei of the Al—Fe—Si-based compound and thereby contribute to improvement of the high temperature strength by dispersion strengthening. However, the heat conductivity is made to fall, so addition of only a slight amount is preferable. Note that Cr and Ti exhibit their advantageous effects with addition of at least one type.

In an aluminum alloy comprised of the above metal structure, the amount of addition of Fe is suppressed and, further, as needed, elements which refine the Al—Fe—Si-based precipitate are added, so it is possible to prevent coarsening of the Al—Fe—Si-based precipitate and reduce the drop in room temperature tensile properties. This effect is particularly exhibited when, the case of adopting a 0.2 $mm^2$ field of view, the average of 10 precipitates which are the largest in size in the longitudinal direction of the precipitates is 230 μm or less, preferably 150 μm or less.

The aluminum alloy of the present invention is obtained by casting by an aluminum melt of a composition of the above additive elements and unavoidable impurities by the gravity casting method or other generally used casting method.

Note that, according to need, when casting, the aluminum alloy melt is treated ultrasonically at a temperature of the liquidus line or more. Due to this, it is possible to promote nucleation and make the structure finer and possible to improve the room temperature characteristics of the aluminum alloy. The aim is to secure room temperature elongation and thereby prevent cracking at the time of working. Furthermore, this promotes precipitation and results in the amount in solid solution being reduced and the heat conductivity being improved by that amount.

The ultrasonic treatment device which is used is, as shown in FIG. 1, comprised of an ultrasonic generator 1, resonator 2, horn 3, and control unit 5.

As one example, the principle of operation of an ultrasonic generation system which forms a magnetostrictive resonator will be explained. An alternating powerful current which is generated by the ultrasonic generator 1 is applied to the ultrasonic resonator 2. The ultrasonic vibration which is generated by the ultrasonic resonator is transmitted through a screw type connection 4 to a horn tip by the horn 3 and is introduced from the front end to the inside of the aluminum melt. To maintain the resonance conditions, a resonance frequency automatic control unit 5 is provided. This unit measures the value of the current which flows to the resonator as a function of the frequency and automatically adjusts the frequency so that the value of current maintains the maximum value.

The ultrasonic horn which is used at this time uses a material which has a high heat resistance and is resistant to erosion even ultrasonically treated in an aluminum metal. For example, a ceramic material, for a metal horn with a high heat resistance, an Nb—Mo alloy, etc. may be selected. Note that by giving, as the vibration to be given, an ultrasonic wave with an amplitude of 10 to 70 μm (p-p), a frequency of 20 to 27 kHz, and an output of 2 to 4 kW or so for about 5 to 30 seconds, refinement can be achieved. Here, "p-p" means "peak-to-peak" and indicates the difference between the maximum value and minimum value in the case of, for example, a sine wave.

Figure 2:
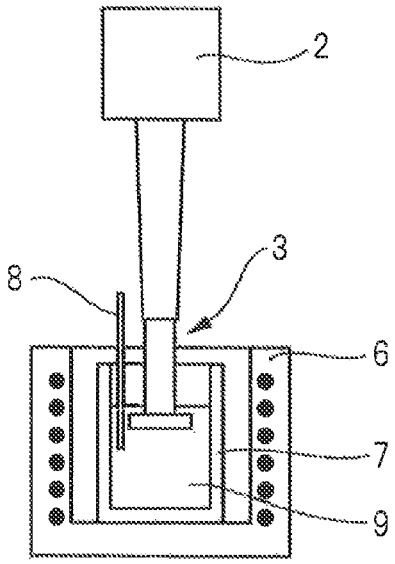
FIG. 2 explains a mode of treatment of an aluminum alloy melt ultrasonically.

As the position of ultrasonic treatment, the example of performing the ultrasonic treatment inside a melting furnace at the time of gravity casting is shown in FIG. 2. Note that, the ultrasonic treatment position is not limited to this, but by casting within 100 seconds from ending the ultrasonic treatment, the effect of ultrasonic treatment is enhanced, so any position which enables the start of casting within 100 seconds from ending the ultrasonic treatment may be used. For example, while not shown, a position in a ladle, in a basin, etc. is also possible.

Further, the casting method is not limited to the gravity casting method. Even with the DC casting method, die cast method, or other casting method, ultrasonic treatment at a predetermined position enables the effect of refinement of the aluminum melt to be obtained.

As a location for ultrasonic treatment for starting casting within 100 seconds, for example, in DC casting, ultrasonic treatment may be performed in within the gutter or within the die, while in die casting, it may be performed within the melting furnace, within the ladle, within the basin, directly above the sleeve, or within the sleeve.

In this way, by making the time from ending the ultrasonic treatment to casting within 100 seconds, it is possible to prevent the dispersed heterogeneous nuclei from returning to their original states and the refining effect from ending up disappearing.

Note that, the alloy melt temperature at the time of the ultrasonic treatment is preferably within 100° C. from the liquidus line. Due to this, it is possible to shorten the time from the ultrasonic treatment to casting. If the melt temperature is too high, the amount of gas in the melt increases and the melt quality falls. Further, there is the danger of the furnace horn etc. falling in lifetime.

Below, specific case studies of manufacture will be explained by examples.

EXAMPLES

Examples 1 to 4, 7, and 8

Aluminum alloy melts which were adjusted to the compositions which are shown in Table 1 were produced. The aluminum alloy melts were cast from a melt pouring temperature of 740° C. into JIS No. 4 boat molds which were heated to 200° C. by gravity casting. Note that, the cooling rate at this time was 24° C./s down to the liquidus line and the cooling rate from the liquidus line to the solidus line was 5.9° C./s.

The thus obtained die casting material was aged at 220° C.×4 hours and air cooled.

To run a 350° C. tensile test and room temperature tensile test, the heat treated alloys were cut to obtain high temperature tensile test pieces and room temperature tensile test pieces. The high temperature tensile test was performed on test pieces after preheating to 350° C. for 100 hours.

The heat conductivity was evaluated by measuring the electro conductivity, which is in a proportional relationship with this, from the heated treated alloys.

The 350° C. tensile properties, room temperature tensile properties, and heat conductivity at this time are shown in Table 2.

TABLE 1

Composition of Ingredients of Test Materials

| | Chemical composition (mass %) | | | | | | | | | | |
|---|---|---|---|---|---|---|---|---|---|---|---|
| Test material | Si | Cu | Ni | Mg | Fe | Mn | Cr | Ti | Zr | V | P |
| Ex. 1 | 15 | 4 | 2.5 | 0.8 | 0.8 | <0.01 | <0.01 | <0.01 | <0.01 | <0.01 | 0.01 |
| Ex. 2 | 15 | 3 | 2 | 0.8 | 0.8 | 0.01 | 0.2 | 0.1 | 0.1 | 0.1 | 0.01 |
| Ex. 3 | 15 | 3 | 2 | 0.8 | 0.8 | 0.01 | <0.01 | 0.1 | 0.1 | 0.1 | 0.01 |
| Ex. 4 | 15 | 3 | 2 | 0.8 | 0.8 | 0.01 | <0.01 | <0.01 | 0.1 | <0.01 | 0.01 |
| Ex. 5 | 13 | 4 | 2 | 1 | 1.2 | 0.08 | 0.1 | 0.2 | 0.1 | 0.1 | 0.01 |
| Ex. 6 | 13 | 4 | 2 | 1 | 1.2 | 0.08 | 0.1 | 0.2 | 0.1 | 0.1 | 0.01 |
| Ex. 7 | 15 | 3 | 2 | 0.8 | 0.8 | <0.01 | <0.01 | 0.1 | 0.2 | <0.01 | 0.01 |
| Ex. 8 | 15 | 3 | 2 | 0.8 | 0.8 | <0.01 | <0.01 | 0.1 | 0.5 | <0.01 | 0.01 |
| Comp. Ex. 1 | 12 | 3 | 2 | 0.7 | 0.5 | 0.5 | <0.01 | 0.2 | 0.1 | 0.1 | 0.01 |
| Comp. Ex. 2 | 13 | 1 | 1 | 1 | 0.1 | 0.01 | <0.01 | 0.01 | <0.01 | <0.01 | 0.01 |

TABLE 1-continued

| Composition of Ingredients of Test Materials | | | | | | | | | | | |
|---|---|---|---|---|---|---|---|---|---|---|---|
| | Chemical composition (mass %) | | | | | | | | | | |
| Test material | Si | Cu | Ni | Mg | Fe | Mn | Cr | Ti | Zr | V | P |
| Comp. Ex. 3 | 13 | 1 | 1 | 1 | 0.1 | 0.01 | <0.01 | 0.01 | <0.01 | <0.01 | 0.01 |
| Comp. Ex. 4 | 15 | 3 | 1 | 1 | 1.7 | 0.8 | 0.6 | 0.4 | <0.01 | <0.01 | 0.01 |
| Comp. Ex. 5 | 15 | 3 | 1 | 1 | 1.7 | 0.8 | 0.6 | 0.4 | <0.01 | <0.01 | 0.01 |

The balance is Al and unavoidable impurities

TABLE 2

| Properties of Test Materials | | | | | | | | | |
|---|---|---|---|---|---|---|---|---|---|
| | 350° C. tensile properties | | | Room temperature tensile properties | | | Heat conductivity | | Precipitate size*1) |
| | σB (MPa) | | δ (%) | σ (MPa) | | δ (%) | (W/(m · K)) | | (μm) |
| Ex. 1 | 80 | G | 10 | 265 | VG | 0.7 | 127 | VG | 117 |
| Ex. 2 | 82 | G | 8.9 | 264 | VG | 0.8 | 123 | G | 115 |
| Ex. 3 | 85 | VG | 7.9 | 281 | VG | 0.6 | 125 | VG | 120 |
| Ex. 4 | 80 | G | 6.7 | 261 | VG | 0.7 | 122 | G | 117 |
| Ex. 5 | 86 | VG | 7.7 | 259 | G | 0.5 | 124 | G | 210 |
| Ex. 6 | 83 | VG | 10.3 | 275 | VG | 0.7 | 127 | VG | 116 |
| Ex. 7 | 80 | G | 7.8 | 275 | VG | 0.7 | 127 | VG | 117 |
| Ex. 8 | 77 | G | 7.8 | 275 | VG | 0.7 | 126 | VG | 117 |
| Comp. Ex. 1 | 81 | G | 7.4 | 267 | VG | 0.8 | 114 | P | 110 |
| Comp. Ex. 2 | 51 | P | 36.7 | 238 | P | 2.2 | 150 | VG | 108 |
| Comp. Ex. 3 | 53 | P | 28.7 | 240 | P | 2 | 150 | VG | 108 |
| Comp. Ex. 4 | 80 | G | 0.4 | 215 | P | 0.2 | 117 | P | 250 |
| Comp. Ex. 5 | 80 | G | 1.7 | 216 | P | 0.2 | 119 | P | 249 |

*1)The precipitate size is the average of 10 precipitates from the largest in the sizes in the longitudinal direction when examining the number of precipitates in a 0.2 $mm^2$ field of view at 200x.

Example 5

An aluminum alloy melt which was adjusted to the composition which is shown in Table 1 was produced. The aluminum alloy melt was cast from a melt pouring temperature of 700° C. into a JIS No. 4 boat mold which was heated to 160° C. by gravity casting. Note that, otherwise, a similar method as in Examples 1 to 4 was used for casting.

The thus obtained die casting material was aged at 220° C.×4 hours and air cooled. After that, in the same way as Example 1, a 350° C. tensile test and room temperature tensile test were run and the heat conductivity was evaluated.

The 350° C. tensile properties, room temperature tensile properties, and heat conductivity at this time are shown in Table 2.

Example 6

As shown in Table 1, an aluminum melt of a composition the same as Example 5 was prepared in a crucible which was arranged inside a melting furnace.

Next, an ultrasonic horn made of an Nb—Mo alloy was preheated in a preheating furnace, then the horn was immersed in the aluminum melt inside the crucible and used for ultrasonic treatment.

The ultrasonic treatment device which was used at this time was an ultrasonic treatment device made by VIATECH. The frequency was set to 20 to 22 kHz and the audio output 2.4 kW for ultrasonic treatment. The vibrational amplitude of the horn was made 20 μm (p-p). The crucible was taken out and the melt was cast after 20 seconds from the end of ultrasonic treatment from a melt pouring temperature of 700° C., to a JIS No. 4 mold which was heated to 160° C., by gravity casting. The liquidus line of the melt at this time was 640° C., while the ultrasonic end temperature was 700° C. There was no problem with castability. Note that, the cooling rates were similar to Examples 1 to 5.

The obtained die casting materials were aged at 220° C.×4 hours and air cooled. After that, in the same way as in Example 1, they were subjected to 350° C. tensile tests and room temperature tensile tests and evaluated for heat conductivity.

The 350° C. tensile properties, room temperature tensile properties, and heat conductivity at this time are shown together in Table 2.

The compositions were the same as in Example 5, but it was learned that ultrasonic treatment enabled improvement of the room temperature tensile properties.

Comparative Examples

Comparative Examples 1 to 5

In the same way, the compositions of the aluminum alloys were adjusted to those of Table 1 and the same method as in the examples was used for casting. The presence of ultrasonic treatment, the ultrasonic treatment temperature, the cooling rate, the melt pouring temperature, and the boat shaped temperature are as explained in Table 3. Note that, Comparative Examples 3 and 5 were treated ultrasonically. The method of ultrasonic treatment was similar to Example 6.

The obtained die casting materials were aged at 220° C.×4 hours and air cooled. After that, in the same way as in Example 1, 350° C. tensile tests and room temperature tensile tests were run and the heat conductivity was evaluated.

The 350° C. tensile properties, room temperature tensile properties, and heat conductivity at this time are shown together in Table 2.

TABLE 3

| | Treatment Conditions | | | | | | |
|---|---|---|---|---|---|---|---|
| | Liquidus line ° C. | Ultra-sonic treat-ment | Treat-ment temp. ° C. | Cooling rate (until liquidus line) ° C./s | Cooling rate (liquidus line to solidus line) ° C./s | Melt pouring temp. ° C. | Boat shape temp. ° C. |
| Ex. 1 | 570 | None | — | 24 | 5.9 | 740 | 200 |
| Ex. 2 | 640 | None | — | 24 | 5.9 | 740 | 200 |
| Ex. 3 | 570 | None | — | 24 | 5.9 | 740 | 200 |
| Ex. 4 | 570 | None | — | 24 | 5.9 | 740 | 200 |
| Ex. 5 | 640 | None | — | 24 | 5.9 | 700 | 160 |
| Ex. 6 | 640 | Yes | 700 | 24 | 5.9 | 700 | 160 |
| Ex. 7 | 570 | None | — | 24 | 5.9 | 740 | 200 |
| Ex. 8 | 570 | None | — | 24 | 5.9 | 740 | 200 |
| Comp. Ex. 1 | 610 | None | — | 24 | 5.9 | 740 | 200 |
| Comp. Ex. 2 | 570 | None | — | 24 | 5.9 | 740 | 200 |
| Comp. Ex. 3 | 570 | Yes | 740 | 24 | 5.9 | 740 | 200 |
| Comp. Ex. 4 | 720 | None | — | 24 | 5.9 | 720 | 150 |
| Comp. Ex. 5 | 720 | Yes | 720 | 24 | 5.9 | 720 | 150 |

As clear from the results which are shown in Table 1, in the test materials which are suitably adjusted in contents of Si, Cu, Ni, Mg, Fe, Mn, and P or further V, Zr, Cr, and Ti, the desired 350° C. tensile properties, room temperature tensile properties, and heat conductivity are obtained (Examples 1 to 8). Furthermore, in Example 6 which was treated ultrasonically, compared with Example 5 which was not treated ultrasonically, it was learned that the room temperature tensile properties were greatly improved.

Figure 3:
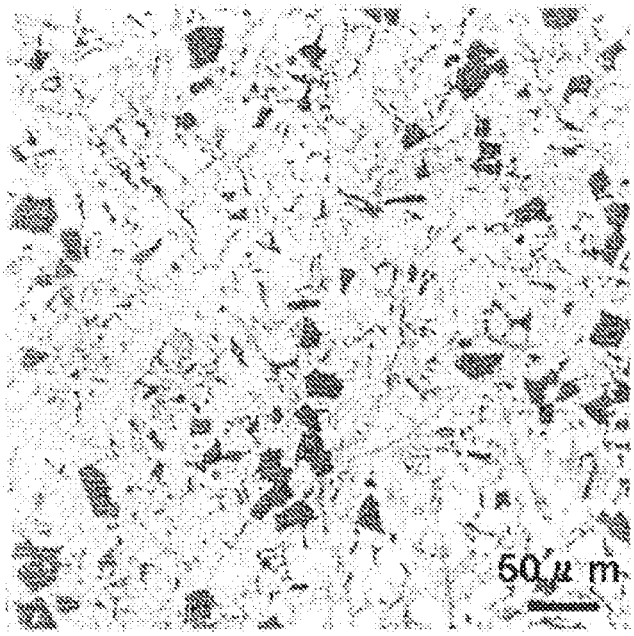
FIG. 3 is a view which shows metal structures of aluminum alloys which were produced in Examples 5 and 6, wherein (a) shows Example 5 without ultrasonic treatment and (b) shows Example 6 with ultrasonic treatment.
Figure 3:
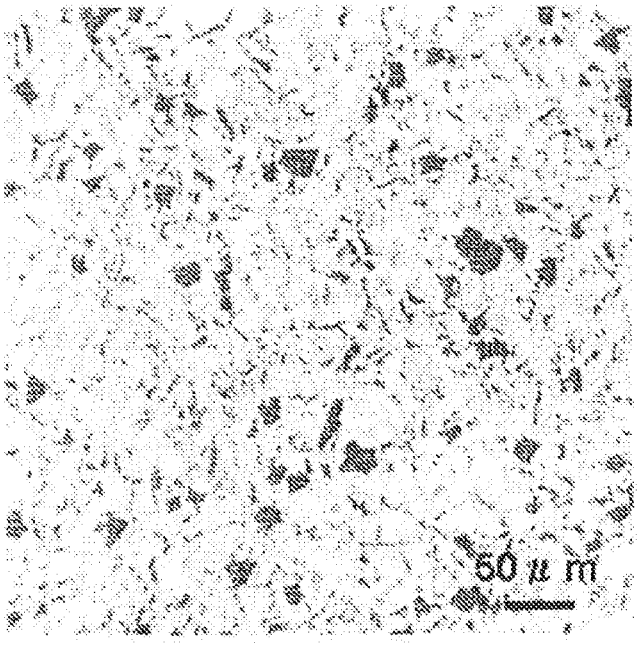

FIG. 3 gives micrographs which show the metallic structure of aluminum alloys which were produced by the above Examples 5 and 6. The white parts are the α-phases, the gray parts are Al—Ni—Cu-based or Al—Fe—Si-based compounds, and the black parts are primary crystal Si crystals. From these photos, it is observed that ultrasonic treatment eliminates the needle-shaped coarse precipitates. It is understood that the presence of such needle shaped coarse precipitates causes the room temperature tensile properties to change.

As opposed to this, in test materials with added alloy ingredients outside the range defined in the claims, the desired 350° C. tensile properties, room temperature tensile properties, and heat conductivity are not obtained (Comparative Examples 1 to 5).

That is, in Comparative Example 1, the 350° C. tensile properties and room temperature tensile properties were good, but the amount of addition of Mn was too large, so it was learned that the heat conductivity was low.

In Comparative Examples 2 and 3, the amounts of addition of the elements which form the intermetallic compounds were small, so the amounts of precipitates were small and the criteria for 350° C. tensile properties and room temperature tensile properties failed to be satisfied. In Comparative Example 3, the alloy was treated ultrasonically, so the room temperature properties rose compared with Comparative Example 2, but even so, both the 350° C. tensile properties and the room temperature tensile properties failed to be satisfactory.

In Comparative Examples 4 and 5, the amounts of addition of Fe were large and the 350° C. tensile properties were good, but the room temperature tensile properties were low. It is believed that the amount of addition of Fe was too large, so the precipitated intermetallic compounds became coarsened and the mechanical properties fell. Further, excessive Mn was added, so the heat conductivity was low. Comparative Example 5 was treated ultrasonically, but failed to be fully improved in the room temperature tensile properties even if treated ultrasonically.

Industrial Applicability

According to the present invention, by adjusting the composition to one which suppresses the drop in high temperature strength and making the Mn content much smaller to reduce the formation of a solid solution in the aluminum, an aluminum alloy which is excellent in high temperature strength and heat conductivity is provided.

REFERENCE SIGNS LIST

1: ultrasonic generator
2: resonator
3: horn
4: screw type connection
5: control unit
6: electric furnace
7: crucible
8: thermocouple
9: melt

The invention claimed is:

1. An aluminum alloy consisting of Si: 12 to 16 mass %, Ni: 0.1 to 2.5 mass %, Cu: 3 to 5 mass %, Mg: 0.3 to 1.2 mass %, Fe: 0.8 to 1.5 mass %, P: 0.004 to 0.02 mass % and a balance of Al and unavoidable impurities and having a 350° C. tensile strength of 77 MPa or more, wherein, when adopting a 0.2 $mm^2$ field view, the alloy has a metal structure where an average of 10 Al—Fe—Si-based precipitates which are the largest in size in the longitudinal direction of the precipitates is 230 μm or less.

2. A method of production of an aluminum alloy which is excellent in high temperature strength and heat conductivity characterized by treating an aluminum alloy melt which has a composition of ingredients as set forth in claim 1 ultrasonically at a temperature of the liquidus line or more and casting it within 100 seconds after the end of the ultrasonic treatment.

3. An aluminum alloy consisting of Si: 12 to 16 mass %, Ni 0.1 to 2.5 mass %, Cu: 3 to 5 mass %, Mg: 0.3 to 1.2 mass %, Fe: 0.8 to 1.5 mass %, P: 0.004 to 0.02 mass %, 0.1 mass % or less of Mn and a balance of Al and unavoidable impurities and having a 350° C. tensile strength of 77 MPa or more, wherein, when adopting a 0.2 $mm^2$ field view, the alloy has a metal structure where an average of 10 Al—Fe—Si-based precipitates which are the largest in size in the longitudinal direction of the precipitates is 230 μm or less.

4. An aluminum alloy consisting of Si: 12 to 16 mass %, Ni: 0.1 to 2.5 mass %, Cu: 3 to 5 mass %, Mg: 0.3 to 1.2 mass %, Fe: 0.8 to 1.5 mass %, P: 0.004 to 0.02 mass %, at least one of 0.01 to 0.1 mass % of V and 0.01 to 0.6 mass % of Zr and a balance of Al and unavoidable impurities and having a 350° C. tensile strength of 77 MPa or more, wherein, when adopting a 0.2 $mm^2$ field view, the alloy has a metal structure where an average of 10 Al—Fe—Si-based precipitates which are the largest in size in the longitudinal direction of the precipitates is 230 μm or less.

5. An aluminum alloy consisting of Si: 12 to 16 mass %, Ni: 0.1 to 2.5 mass %, Cu: 3 to 5 mass %, Mg: 0.3 to 1.2 mass %, Fe: 0.8 to 1.5 mass %, P: 0.004 to 0.02 mass %, at least one of 0.01 to 0.2 mass % of Cr and 0.01 to 0.2 mass % of Ti and a balance of Al and unavoidable impurities and having a 350° C. tensile strength of 77 MPa or more, wherein, when adopting a 0.2 $mm^2$ field view, the alloy has a metal structure where an average of 10 Al—Fe—Si-based precipitates which are the largest in size in the longitudinal direction of the precipitates is 230 μm or less.

* * * * *